United States Patent [19]

Schwade et al.

[11] 4,399,773

[45] Aug. 23, 1983

[54] SOOT BLASTER

[75] Inventors: Hans Schwade, Voerde; Karl Albers, Anholt, both of Fed. Rep. of Germany

[73] Assignee: Bergemann GmbH, Wesel, Fed. Rep. of Germany

[21] Appl. No.: 324,994

[22] Filed: Nov. 25, 1981

[30] Foreign Application Priority Data

Mar. 27, 1981 [DE] Fed. Rep. of Germany ..... 3112121

[51] Int. Cl.[3] ..... F22B 37/52

[52] U.S. Cl. ..... 122/390; 15/317; 122/392

[58] Field of Search ..... 122/390, 391, 392; 15/317; 134/167 C

[56] References Cited

U.S. PATENT DOCUMENTS 4,354,294 10/1982 Silver ..... 122/392 R

FOREIGN PATENT DOCUMENTS 768916 10/1967 Canada ..... 122/390

*Primary Examiner*—Edward G. Favors

*Attorney, Agent, or Firm*—Max Fogiel

[57] ABSTRACT

A soot blaster has a lance tube which is retractable and linearly movable. At least one of these movements can be interrupted by a time-delay relay when the tube reaches its frontmost operating position.

7 Claims, 5 Drawing Figures

SOOT BLASTER

BACKGROUND OF THE INVENTION

The present invention relates to a soot blaster.

Soot blasters are used to blast sooty deposits off hot surfaces, especially off heating surfaces of boilers and the like. They use a tube-shaped lance having one or more outlet nozzles through which a gaseous and/or liquid blasting medium is expelled at high velocity. The lance is turningly inserted into the space to be cleaned, advanced to its leading end position and is then retracted again.

It is customary that the tip of the lance is provided with two opposite nozzles. If so, these perform during the cleaning operation a double-helix movement, the spacing of the helices being equal to half of the selected forward movement per rotation of the lance. The drive elements for the longitudinal and rotary movement during each cleaning incident will always be the same. That is to say that the fluid blasts invariably contact the same areas of the surface being cleaned, which eventually leads to erosion damage to these surfaces.

To avoid this, it is known from German Pat. No. 2,757,981 to so construct the soot blaster that each cleaning incident is begun with the nozzles in a different position. This construction proposes to use two free-wheeling devices between the drive shaft for the longitudinal drive and the drive for the rotary motion. These devices are actuatable in mutually opposite directions and one of them has a predetermined play built into it in direction of rotation of the drive shaft.

SUMMARY OF THE INVENTION

The purpose of the present invention is to obtain the same advantages as the aforementioned German but with different means.

A more specific object of the invention is to provide an improved soot blaster which can start every cleaning incident with a different nozzle position, but wherein this is achieved with very simple means suited to the rough working conditions of such a device.

Pursuant to these objects, and still others which will become apparent hereafter, one aspect of the invention resides in a soot blaster comprising a lance tube for emission of high-velocity fluid jets, rotating means for rotating the lance tube, drive means for linearly advancing and retracting the lance tube, at least one coupling interposed between the lance tube and one of the means, a limit switch at a forward end of the lance tube path and a time-delay relay controlled by the limit switch and connected to the coupling.

The invention will hereafter be described with reference to exemplary embodiments as shown in the appended drawings. However, these are to be understood as being of a purely explanatory nature.

DESCRIPTION OF PREFERRED EMBODIMENTS

Figure 1:
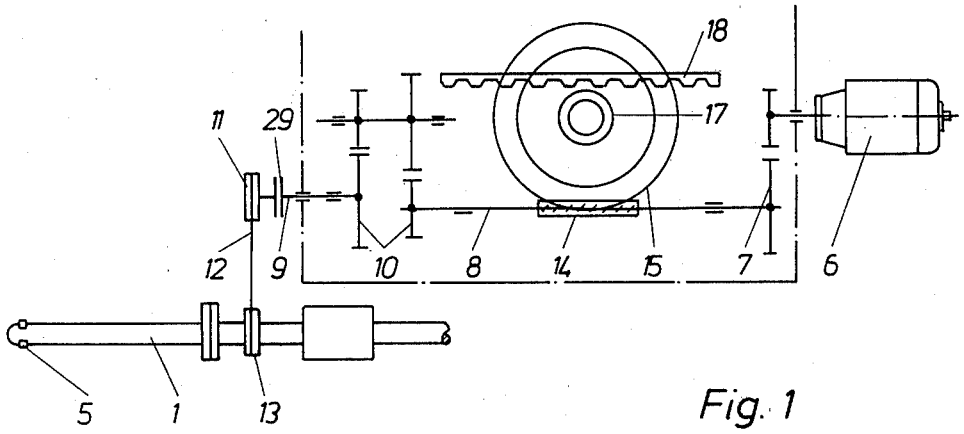
FIG. 1 is a schematic illustration of the drive for a soot blaster according to the invention.
Figure 3:
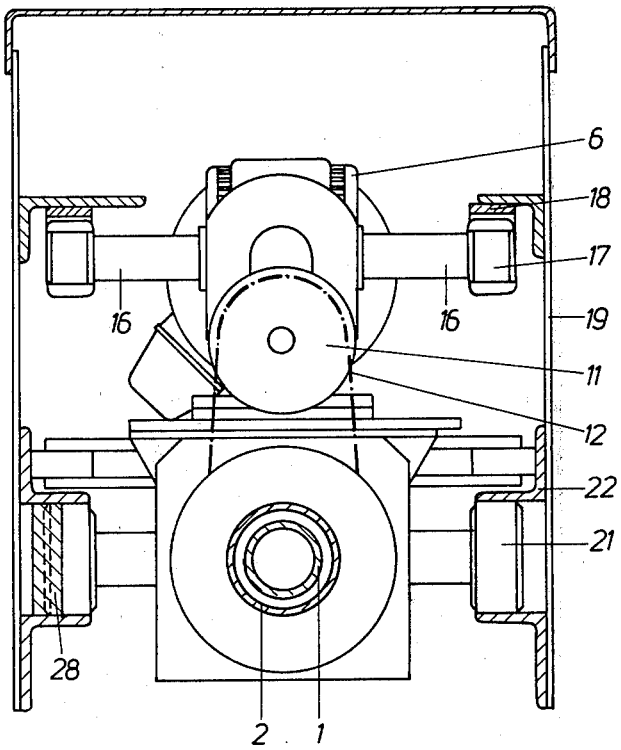
FIG. 3 is a section on line III—III of FIG. 2.
Figure 2:
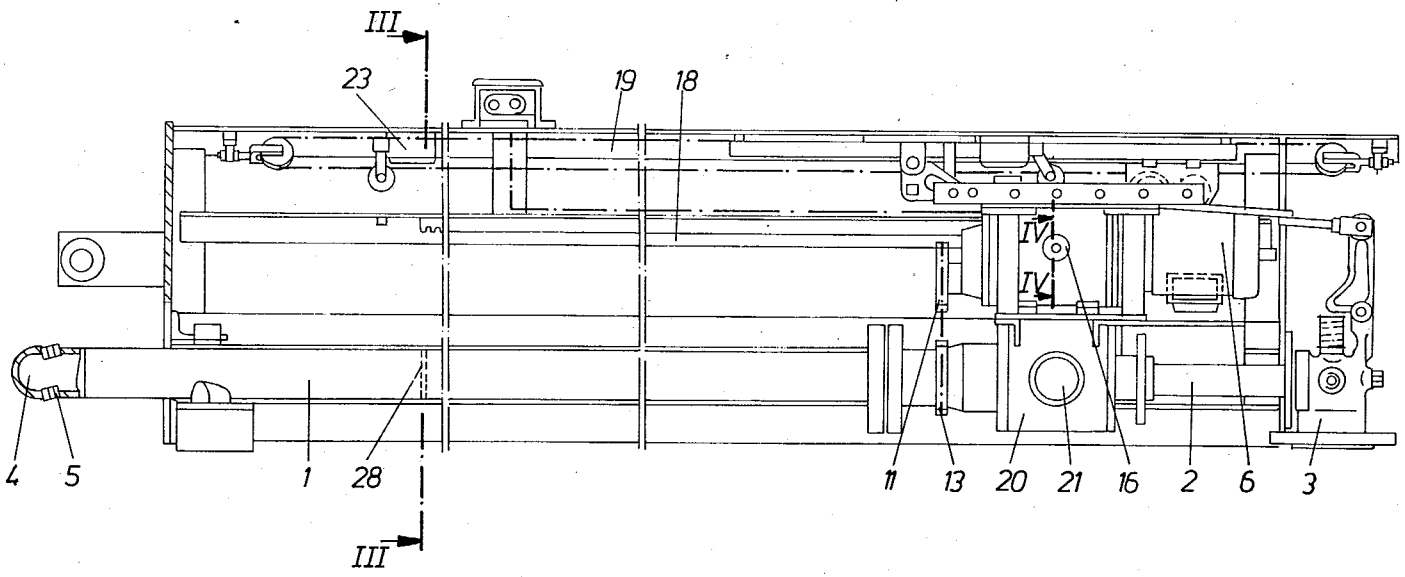
FIG. 2 is a side view of the soot blaster.
Figure 4:
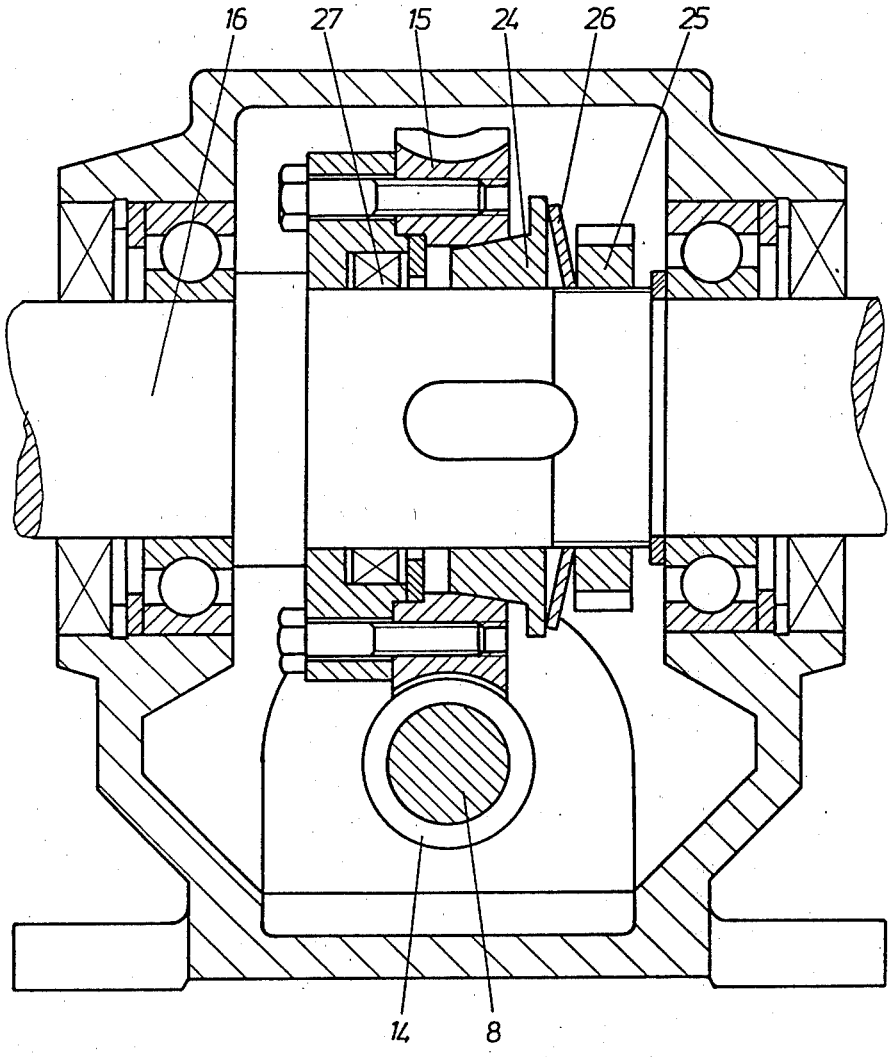
FIG. 4 is a section on line IV—IV of FIG. 2.

The soot blaster illustrated overall in FIGS. 1–5 is composed of a lance tube 1 which is guided on an inner tube 2. The rear end of the inner tube 2 is provided with a blow valve 3, i.e. a valve through which a blowing medium (e.g. steam) is fed to the lance tube 1 via the inner tube 2. The front end of the lance tube 1 carries a nozzle head 4 provided with two oppositely located nozzles 5. Lance tube 1 is shifted lengthwise under simultaneous rotation, so that the nozzles 5 (and the blast streams issuing from them) travel in a helical path.

This movement is effected by means of a motor 6 which rotates a drive shaft 8 via a transmission 7. Shaft 8 is coupled with three output shafts, one of which is a rotary shaft 9 coupled to shaft 8 via a gearing arrangement. A sprocket 11 is mounted on shaft 9 and a second sprocket 13 is mounted on the lance tube 1; the two sprockets are linked in motion-transmitting relationship by a chain 12.

The two other output shafts 16, namely the ones for linear motion of the lance tube, are driven by a worm wheel 15 which is in turn rotated by a worm gear 14 mounted on a shaft 8. Each shaft 16 carries a fixed pinion 17 which engages a rack 18. The two racks 18 are mounted on a stationary carrier 19.

Lance tube 1 is connected with a blasting carriage 20 which is provided with rollers 21 that move on rails 22 of the carrier 29. The transmission with the drive 10, the worm wheel 15 and the motor 6 is flanged to the carriage 20 so that, when motor 6 is energized, the lance tube 1 is shifted lengthwise while simultaneously being rotated. At the front end of the advancing stroke for lance tube 1 there is mounted a limit switch 23 which, when triggered by the carriage or some other part, yields an impulse that causes motor 6 to become reversed so that the lance tube is retracted to its outer end or starting position.

The basic intent of the invention is, of course, to assume that each blasting (i.e. cleaning) incident will begin with the nozzles 5 in a different position from the previous one. For this purpose the lance tube 1 is connected via a coupling either with the lengthwise drive or with the rotary drive. In the illustrated embodiment the coupling associated with the lengthwise drive is a slip coupling 24, i.e. a friction coupling which connects the worm wheel 15 and the shafts 16. A dished spring 26 is incorporated between the coupling 24 and a shaft nut 25. If the nut 25 is displaced lengthwise on the shaft (which can be effected from outside the device), the maximum torque transmission moment of the coupling 24 can thus be adjusted. The setting is so selected that the torque moment is smaller than the maximum drive torque of motor 6.

A free-wheeling device 27 (known per se) is provided between the worm wheel 15 and the shafts 16 and becomes effective only during the retraction movement of the lance tube 1 by transmitting motion between shafts 16 and worm wheel 15. This assures that even in the event of service problems or breakdowns the lance tube 1 can be retracted from the hot spaces being cleaned, with maximum motor torque and in order to avoid damage to it.

An abutment 28 cooperates with the coupling 24 and is provided at the end of the stroke for lance tube 1 on the rails 22. A timing delay is provided which is coupled with the end switch 23, to delay the switch impulse (for reversal of the motor 6) by a selectable time interval.

When carriage 20 engages abutment 28, the coupling 24 slips and interrupts further motion transmission, whereas rotation of lance tube 1 is maintained via shaft 8, gearing 10, shaft 9 and sprockets 11, 13. The time for which coupling 24 is so allowed to slip, can be set at the time-delay relay. Thus, the nozzles are always angularly displaced at the end of the lance tube forward movement and before lance tube retraction begins.

Figure 5:
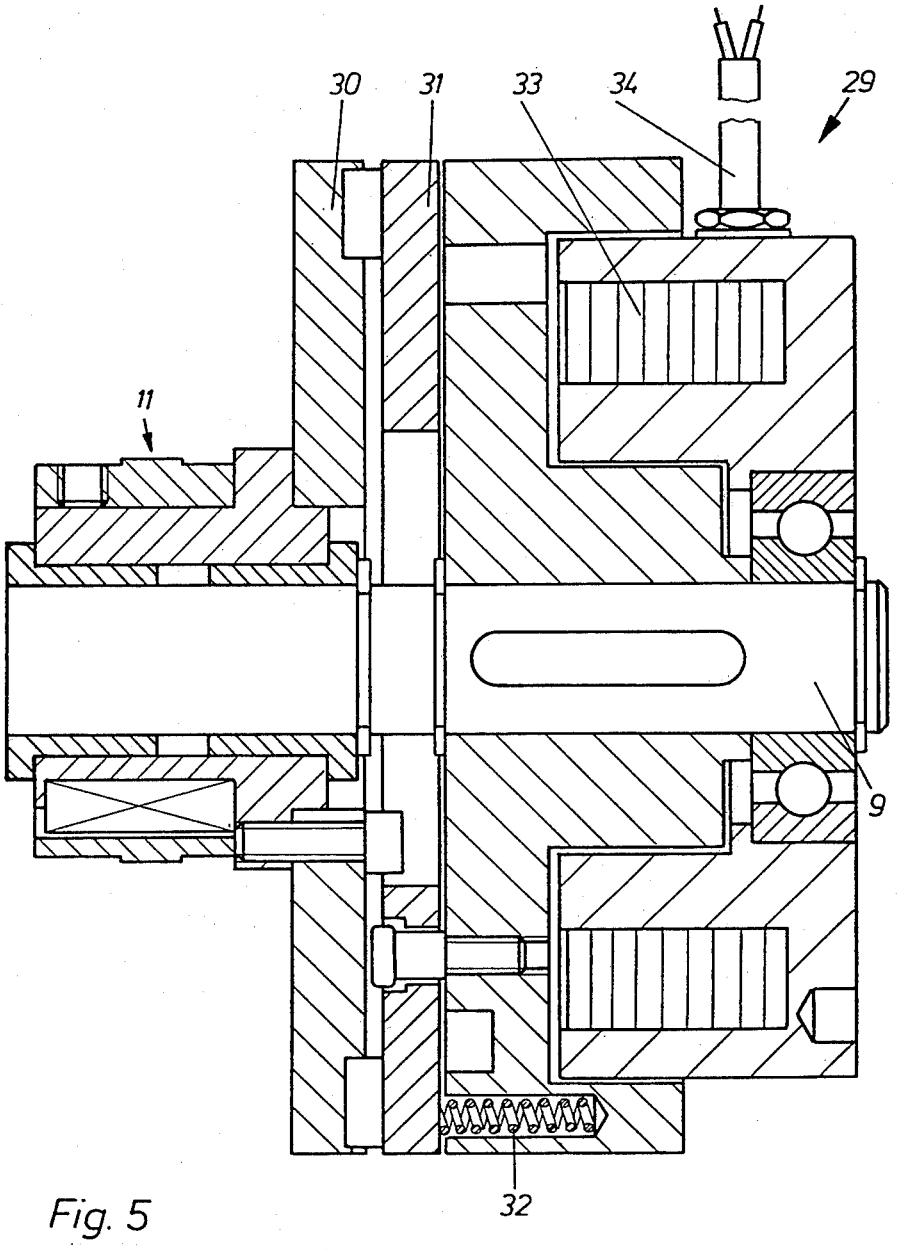
FIG. 5 is a longitudinal section through a coupling suitable for the soot blaster drive.

The same effect can be obtained in a modified version, in which coupling 24 is omitted, and worm wheel 15 directly connected with the shaft 16. As indicated in FIGS. 1 and 5, this then requires the use of a known-per-se switching coupling 29 which is arranged between the shaft 9 and the sprocket 11. It contains two coupling disks 30, 31 which are pressed together by springs 32. An electromagnet 33 is mounted in the coupling half containing the springs 32. Its force, when energized, acts counter to that of the springs 32 so that the disks 30, 31 are then released from one another. An electrical terminal 34 of electromagnet 33 is connected with the time-delay relay of the limit switch 23.

Evidently, while the disks 30, 31 are out of engagement, motion-transmission is interrupted between shaft 9 and sprocket 11, so that rotation of lance tube 1 ceases. However, linear movement continues.

The invention has been described with reference to exemplary embodiments which are subject to modifications. Therefore, all such modifications are intended to be encompassed by the appended claims.

We claim:

1. Soot blaster, comprising: a lance tube for emission of high-velocity fluid jets; rotating means for rotating said lance tube; drive means for linearly advancing and retracting said lance tube; at least one coupling interposed between the lance tube and one of said means; a limit switch at a forward end of the lance tube path; a time-delay relay controlled by said limit switch and connected with said coupling; said coupling being interposed between said drive means and said lance tube; and a single electric motor for operating said drive means; said coupling being disengaged for a predetermined time interval set by said time-delay relay; said single motor generating two components of motion comprising linear and rotary motions of the lance tube, said motor continuing to generate one component of motion when the other component of motion is arrested, said limit switch releasing the arrested component of motion by applying a signal through said relay to reverse the motor and thereby retract the lance tube after position of said jets has been changed, so that said coupling is temporarily disengaged and the jets define a different path, every blasting process being initiated at a different jet position.

2. A soot blaster as defined in claim 1, wherein said coupling comprises a slip coupling; a carrier for said lance tube and defining a pathway therefor; and a fixed abutment mounted on said pathway.

3. A soot blaster as defined in claim 2, wherein the torque of said coupling is smaller than the maximum output torque of said electric motor.

4. A soot blaster as defined in claim 1, wherein said coupling comprises a slip coupling; a carrier for said lance tube and defining a pathway therefor; a fixed abutment mounted on said pathway; said coupling having a torque which is smaller than the maximum output torque of said electric motor; a free-wheeling device operative for motion transmission only during retraction of said lance tube; said coupling having an adjustable torque.

5. Soot blaster as defined in claim 3, and further comprising a free-wheeling device which is operative for motion transmission only during retraction of said lance tube.

6. Soot blaster as defined in claim 3, wherein the torque of said slip coupling is adjustable.

7. Soot blaster as defined in claim 1, wherein said coupling is a switching coupling arranged between an input shaft of said soot blaster and said rotating means, respectively.

* * * * *